US011123786B2

(12) United States Patent
Xu et al.

(10) Patent No.: US 11,123,786 B2
(45) Date of Patent: Sep. 21, 2021

(54) TRIMMING DIE FOR CASTING OF FRONT STEERING KNUCKLE IN DOUBLE-WISHBONE SUSPENSION

(71) Applicant: CITIC Dicastal CO., LTD., Hebei (CN)

(72) Inventors: Zuo Xu, Qinhuangdao (CN); Haijun Guo, Qinhuangdao (CN); Dengyao Li, Qinhuangdao (CN); Zhi Chen, Qinhuangdao (CN); Yacong Zhang, Qinhuangdao (CN)

(73) Assignee: CITIC DICASTAL CO., LTD, Hebei (CN)

( * ) Notice: Subject to any disclaimer, the term of this patent is extended or adjusted under 35 U.S.C. 154(b) by 0 days.

(21) Appl. No.: 16/830,340

(22) Filed: Mar. 26, 2020

(65) Prior Publication Data

US 2020/0406332 A1 Dec. 31, 2020

(30) Foreign Application Priority Data

Jun. 27, 2019 (CN) ..... 201920980351.1

(51) Int. Cl.
*B21D 28/14* (2006.01)
*B21D 28/16* (2006.01)
*B21D 53/88* (2006.01)

(52) U.S. Cl.
CPC ..... *B21D 28/14* (2013.01); *B21D 28/16* (2013.01); *B21D 53/88* (2013.01); *B21D 53/883* (2013.01); *Y10T 83/9428* (2015.04)

(58) Field of Classification Search
CPC ..... Y10T 83/7035; Y10T 83/9411; Y10T 83/9416; Y10T 83/9418; Y10T 83/9423; Y10T 83/9425; Y10T 83/9428; Y10T 83/9437; Y10T 83/9444; Y10T 83/9447; B21D 28/14; B21D 28/16; B21D 28/00; B21D 45/00; B21D 53/88; B21D 53/886; B26D 7/26; B26D 7/01
See application file for complete search history.

(56) References Cited

U.S. PATENT DOCUMENTS 4,103,574 A * 8/1978 Greer ..... B21D 28/34 279/24
2004/0231398 A1* 11/2004 Bliss ..... B21D 22/02 72/481.1
2006/0011029 A1* 1/2006 Irwin ..... B65D 1/34 83/13
2016/0193747 A1* 7/2016 Greenleaf ..... B21D 28/346 83/143

* cited by examiner

*Primary Examiner* — Phong H Nguyen
(74) *Attorney, Agent, or Firm* — Cooper Legal Group, LLC

(57) ABSTRACT

The present disclosure relates to the technical field of trimming dies and specifically relates to a trimming die for a casting of a front steering knuckle in a double-wishbone suspension. The trimming die includes an upper roof, an intermediate plate, a movable plate, a base, springs, connecting columns, a pressing block connecting rod, a cutting edge, a pressing block, a casting, hold-down blocks, a first supporting block and second supporting blocks.

11 Claims, 3 Drawing Sheets

TRIMMING DIE FOR CASTING OF FRONT STEERING KNUCKLE IN DOUBLE-WISHBONE SUSPENSION

CROSS-REFERENCE TO RELATED APPLICATION

The present application claims benefit of Chinese Patent Application No. 201920980351.1, filed on Jun. 27, 2019, the contents of which are hereby incorporated by reference in their entirety.

BACKGROUND

A suspension with a double-wishbone structure is generally adopted in some high-end automobile chassis, a front steering knuckle in a double-wishbone suspension is generally produced by casting, the steering knuckle is of a slender and bent gooseneck type, as shown in FIG. 1, A is a gooseneck of the front steering knuckle, and B is a goose head of the front steering knuckle. However, the gooseneck-type steering knuckle can deform in a thermal treatment process, and the deformation at the gooseneck at the tail end of the steering knuckle is most serious. Thermal treatment deformation results in great increment of rejection rate of the steering knuckle of this type, and therefore, the production costs of factories are seriously affected.

SUMMARY

The present disclosure relates to the technical field of trimming dies and specifically relates to a trimming die for a casting of a front steering knuckle in a double-wishbone suspension.

The embodiment of the present disclosure provides a trimming die for a casting of a front steering knuckle in a double-wishbone suspension. Waste products generated by thermal treatment deformation of the casting are reduced by correcting the casting during trimming, so that the production cost is reduced.

In order to achieve the aim, the present disclosure provides the following technical solution:

the present disclosure provides a trimming die for a casting of a front steering knuckle in a double-wishbone suspension, including a base, a first supporting block, second supporting blocks and an upper die, herein the base is located at a bottom of the die, the first supporting block and the second supporting blocks are fixedly arranged on the base, a gooseneck of the casting is supported by the first supporting block, the remaining parts of the casting are supported by the second supporting blocks, the upper surfaces of the first supporting block and the second supporting blocks are respectively adapted to the shapes of the corresponding bottom surfaces of the casting, the second supporting blocks are in complete contact with the casting, and a gap is reserved between the first supporting block and the casting; the upper die includes a pressing block, hold-down blocks and a cutting edge, the pressing block is located over a goose head of the casting, the hold-down blocks are located over the remaining parts of the casting, and the pressing block and the hold-down blocks are respectively adapted to the shapes of the corresponding upper surfaces of the casting; the cutting edge is used for clearing fins of the casting, and the pressing block and the cutting edge are capable of moving synchronously; and when the die is closed, the casting is held down by the hold-down blocks pressing against the upper surface, except for the goose head, of the casting, the fins of the casting are cleared by the cutting edge, and the pressing block presses against the goose head of the casting and is in interference fit with the goose head of the casting to realize the correction of the casting. In the embodiment, a gap is reserved between a first supporting block and the casting, a pressing block and hold-down blocks are designed to be separated, the first supporting block and second supporting blocks are designed to be separated, the correction of the casting is realized by enabling the pressing block to downwards press the casting towards the gap due to the mutual cooperation of the pressing block and the first supporting block, waste products generated by thermal treatment deformation of the casting are reduced, and therefore, the production cost is reduced.

In some embodiments, herein the side face, facing the hold-down blocks, of the pressing block may be provided with an extension part adapted to the goose head of the casting in shape, and the extension part extends along the gap between the goose head of the casting and the hold-down blocks; and with the downward pressing of the pressing block, the extension part can be in interference fit with the goose head of the casting. Due to the design of an extension part of the pressing block in the embodiment, the gooseneck of the casting is further corrected, so that the correcting effect of the casting is better.

In some embodiments, herein the upper die may further include an upper roof, an intermediate plate, a movable plate, a plurality of springs, a plurality of connecting columns and a pressing block connecting rod; the intermediate plate is fixedly connected to a bottom surface of the upper roof by a plurality of connecting columns, the movable plate is located between the upper roof and the intermediate plate and is capable of moving up and down relative to the upper roof, the cutting edge is fixedly arranged on a bottom surface of the intermediate plate, and the pressing block is fixedly arranged on the bottom surface of the intermediate plate by the pressing block connecting rod; the plurality of springs are arranged between the movable plate and the upper roof, and the hold-down blocks are located below the intermediate plate and are fixedly arranged on a bottom surface of the movable plate by a plurality of connecting columns; the intermediate plate is provided with through holes for allowing the plurality of connecting columns on the bottom surface of the movable plate to pass through in positions corresponding to the connecting columns on the bottom surface of the movable plate; and the movable plate is provided with through holes for allowing the plurality of connecting columns on the bottom surface of the upper roof to pass through in positions corresponding to the connecting columns on the bottom surface of the upper roof. A specific structure of an upper die is designed in the embodiment, a movement way of the trimming die is that an upper roof is stressed to drive the overall upper die to fall, a plurality of springs are arranged between the upper roof and a movable plate and are compressed to drive the movable plate to drive hold-down blocks to hold down the casting, then, the upper roof and the intermediate plate continue to fall to drive the pressing block to fall together with a cutting edge, fins of the casting are cleared by the cutting edge, and meanwhile, the pressing block and the first supporting block cooperate with each other, so that the correction of the casting is realized.

In some embodiments, herein the length of the pressing block connecting rod may be adjustable. The pressing block is inconvenient to replace, so that the length of a pressing block connecting rod is designed to be adjustable, in this way, the pressing block can apply downward pressing forces with different degrees to a goose head of the casting by adjusting the length of the pressing block connecting rod, so that it is convenient to realize correction with different degrees, and the die is simple in structure and capable of adapting to correction with different degrees.

In some embodiments, herein the pressing block connecting rod may be detachably connected with the pressing block and the intermediate plate. The pressing block is inconvenient to replace, so that the pressing block connecting rod can be arranged to be replaceable, and the pressing block can apply downward pressing forces with different degrees to the goose head of the casting by replacing pressing block connecting rods with different length standards according to different-degree correction demands, so that it is convenient to realize correction with different degrees, and the die is simple in structure and capable of adapting to correction with different degrees.

In some embodiments, herein both the pressing block and the first supporting block may be detachable, so that the heights of the pressing block and the first supporting block can be conveniently adjusted to adapt to castings with different deformations. The pressing block and the first supporting block are designed to be detachable in the embodiment, the correction quantity can be adjusted by adjusting the heights of the first supporting block and the pressing block to correct the casting with different-degree deformations of the front steering knuckle in the double-wishbone suspension, so that the die is improved in adaptability and beneficial to actual application.

Compared with the related art, the present disclosure has following beneficial effects:

the present disclosure provides the trimming die for the casting of the front steering knuckle in the double-wishbone suspension so that problems existing in the background art are solved, the gooseneck of the casting is corrected by mutual cooperation of the first supporting block and the pressing block, the casting is corrected while being subjected to trimming, and the waste products generated by thermal treatment deformation of the casting are reduced under the condition that the production efficiency is not reduced, so that the production cost is reduced. In addition, the surfaces, corresponding to the casting, of all the pressing block, the hold-down blocks and the supporting blocks are designed to be profiled, so that pressing marks can be prevented from being generated on the casting in a correction process; and the pressing block and the first supporting block are designed to be detachable, and the correction quantity can be adjusted by adjusting the heights of the first supporting block and the pressing block, so that the die is improved in adaptability and strong in practicability.

BRIEF DESCRIPTION OF DRAWINGS

In order to more clearly explain the technical solution in the embodiments of the present disclosure, drawings which require to be used in description of the embodiments are simply introduced below, obviously, the drawings in description below are some embodiments of the present disclosure, and those having ordinary skill in the art can further acquire other drawings without creative efforts according to those drawings.

LIST OF REFERENCE SYMBOLS

Figure 1:
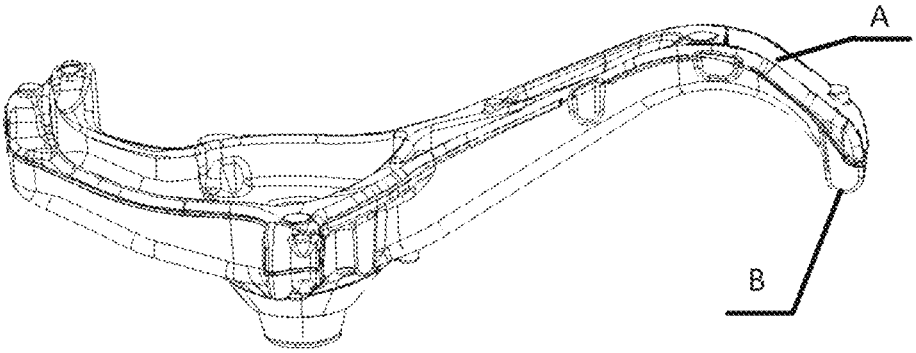
FIG. 1 is a structural schematic diagram of a front steering knuckle in a double-wishbone suspension.
Figure 2:
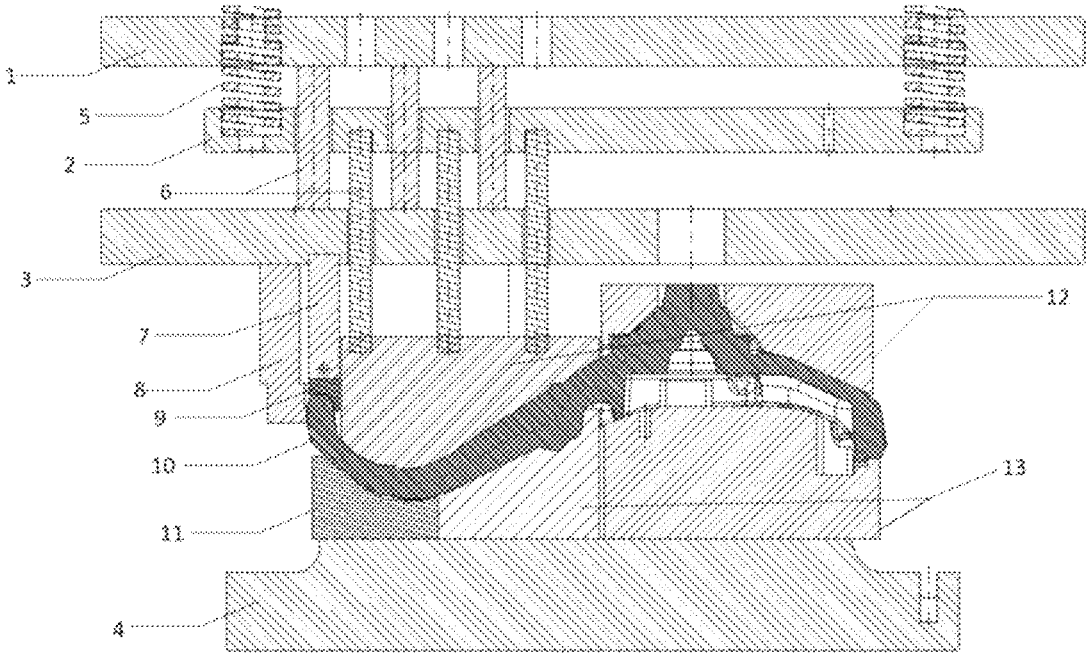
FIG. 2 is a structural schematic diagram of a trimming die for a casting of the front steering knuckle in the double-wishbone suspension provided by the present disclosure.

A—gooseneck of casting, B—goose head of casting, 1—upper roof, 2—movable plate, 3—intermediate plate, 4—base, 5—spring, 6—connecting column, 7—pressing block connecting rod, 8—cutting edge, 9—pressing block, 10—casting, 11—first supporting block, 12—hold-down block, 13—second supporting blocks.

DETAILED DESCRIPTION

The technical solution in the embodiments of the present disclosure is clearly and completely described in combination with drawings of the embodiments of the present disclosure below, and obviously, the described embodiments are part of embodiments of the present disclosure rather than all embodiments. Based on the embodiments of the present disclosure, all the other embodiments obtained by those having ordinary skill in the art without any creative works are within the protection scope of the present disclosure.

The terms "first", "second", "third", "fourth" and the like in the specification and in the claims of the present disclosure are used for distinguishing different objects but not for describing a specific sequence. Furthermore, the terms "include" and "have" as well as their any variations are intended to cover a non-exclusive inclusion. For example, a process, method, system, product or equipment including a series of steps or units does not limit steps or units which have been listed, but selectively further includes steps or units which are not listed, or selectively further includes other inherent steps or units for the process, method, product or equipment.

Reference in the specification to "embodiments" of the present disclosure means that a particular feature, structure or characteristic described in connection with the embodiments is included in at least one embodiment of the present disclosure. The appearances of the phrase "the embodiments" in various places in the specification are not necessarily all referring to the same embodiment, nor are separate or alternative embodiments necessarily mutually exclusive of other embodiments. It will be explicitly and implicitly understood by those skilled in the art that the embodiments described in the present disclosure can be combined to other embodiments.

In order to further understand the content, features and functions of the disclosure, the following embodiments are given and illustrated with the attached drawings as follows.

First Embodiment

The first Embodiment of the present disclosure is described below in combination with accompanying drawings 1-3 of the description, a trimming die for a casting of a front steering knuckle in a double-wishbone suspension includes an upper roof 1, a movable plate 2, an intermediate plate 3, a base 4, springs 5, connecting columns 6, a pressing block connecting rod 7, a cutting edge 8, a pressing block 9, a casting 10, a first supporting block 11, hold-down blocks 12 and second supporting blocks 13. The base 4 is located at the bottom of the die, the first supporting block 11 and the second supporting blocks 13 are fixedly arranged on the base 4, a gooseneck of a casting 10 is supported by the first supporting block 11, the remaining parts of the casting 10 are supported by the second supporting blocks 13, and the upper surfaces of the first supporting block 11 and the second supporting blocks 13 are respectively adapted to the shapes of the corresponding bottom surfaces of the casting 10. The second supporting blocks 13 are in complete contact with the casting 10, and a gap is reserved between the first supporting block 11 and the casting 10.

The upper die of the trimming die includes the upper roof 1, the intermediate plate 2, the movable plate 3, the springs 5, the plurality of connecting columns 6, the pressing block connecting rod 7, the cutting edge 8, the pressing block 9 and the hold-down blocks 12. The intermediate plate 3 is fixedly connected to the bottom surface of the upper roof 1 by a plurality of connecting columns 6, the movable plate 2 is located between the upper roof 1 and the intermediate plate 3 and is capable of moving up and down relative to the upper roof 1, the cutting edge 8 is fixedly arranged on the bottom surface of the intermediate plate 3, and the pressing block 9 is fixedly arranged on the bottom surface of the intermediate plate 3 by the pressing block connecting rod 7; and the movable plate 2 is movably connected to the upper roof 1 by connecting rods of which two ends are provided with limiting caps, two limiting caps are located at two ends of each connecting rod with one being located on the upper roof 1 and the other being located under the movable plate 2, so that the movable plate 2 is prevented from being disengaged from the upper roof 1. A plurality of springs 5 are arranged between the movable plate 2 and the upper roof 1, the peripheries of the parts, positioned between the upper roof 1 and the movable plate 2, of the connecting rods are sleeved with the springs 5, the hold-down blocks 12 are located below the intermediate plate 3, are connected with the movable plate 2 by connecting columns 6 and are fixedly arranged on the bottom surface of the movable plate 2 by the plurality of connecting columns 6; the intermediate plate 3 is provided with through holes for allowing the plurality of connecting columns 6 on the bottom surface of the movable plate 2 to pass through in positions corresponding to the connecting columns 6 on the bottom surface of the movable plate 2; and the movable plate 2 is provided with through holes for allowing the plurality of connecting columns 6 on the bottom surface of the upper roof 1 to pass through in positions corresponding to the connecting columns 6 on the bottom surface of the upper roof 1.

The pressing block 9 is located over a goose head of the casting 10, the hold-down blocks 12 are located over the remaining parts of the casting 10, and the pressing block 9 and the hold-down blocks 12 are respectively adapted to the shapes of the corresponding upper surfaces of the casting 10; and the cutting edge 8 is used for clearing fins of the casting 10, and the pressing block 9 and the cutting edge 8 are capable of moving synchronously. The pressing block 9 is fixedly arranged on the intermediate plate 3 by the pressing block connecting rod 7, and the cutting edge 8 is fixedly arranged on the intermediate plate 3, and thus, the synchronous movement of the pressing block 9 and the cutting edge 8 can be realized. In addition, the length of the pressing block connecting rod 7 is adjustable. The pressing block 9 is inconvenient to replace, so that the length of the pressing block connecting rod 7 is designed to be adjustable, in this way, the pressing block 9 can apply downward pressing forces with different degrees to the goose head of the casting by adjusting the length of the pressing block connecting rod 7, so that it is convenient to realize correction with different degrees, and the die is simple in structure and capable of adapting to correction with different degrees. When the die is closed, the casting 10 is held down by the hold-down blocks 12 pressing against the upper surface, except for the goose head, of the casting 10, the fins of the casting are cleared by the cutting edge 8, and the pressing block 9 presses against the goose head of the casting 10 and is in interference fit with the goose head of the casting to realize the correction of the casting 10. In addition, the side face, facing the hold-down blocks 12, of the pressing block 9 is provided with an extension part adapted to the goose head of the casting in shape, and the extension part extends along the gap between the goose head of the casting and the hold-down blocks 12; and with the downward pressing of the pressing block 9, the extension part can be in interference fit with the goose head of the casting. On one hand, the gap is reserved between the first supporting block 11 and the casting 10, the pressing block 9 and the hold-down blocks 12 are designed to be separated, the first supporting block 11 and the second supporting blocks 13 are designed to be separated, and the correction of the casting 10 is realized by enabling the pressing block 9 to downwards press the casting 10 towards the gap due to the mutual cooperation of the pressing block 9 and the first supporting block 11. On the other hand, due to the design of the extension part of the pressing block 9, the gooseneck of the casting 10 is further corrected, so that the correcting effect of the casting 10 is better.

When the trimming die is used for trimming, the movement way of the trimming die is that the upper roof 1 is stressed to drive the overall upper die to fall, after the hold-down blocks 12 are in contact with the upper surface of the casting, the upper roof 1 is further downwards pressed, the distance from the upper roof 1 to the movable plate 2 is shortened, the plurality of springs 5 are arranged between the upper roof 1 and the movable plate 2 and are compressed to drive the movable plate 2 to drive the hold-down blocks 12 to hold down the casting 10. Then, the upper roof 1 and the intermediate plate 3 continue to fall to drive the pressing block 9 to fall together with the cutting edge 8, fins of the casting 10 are cleared by the cutting edge 8, and meanwhile, the pressing block 9 and the first supporting block 11 cooperate with each other, so that the correction of the casting 10 is realized.

Figure 3:
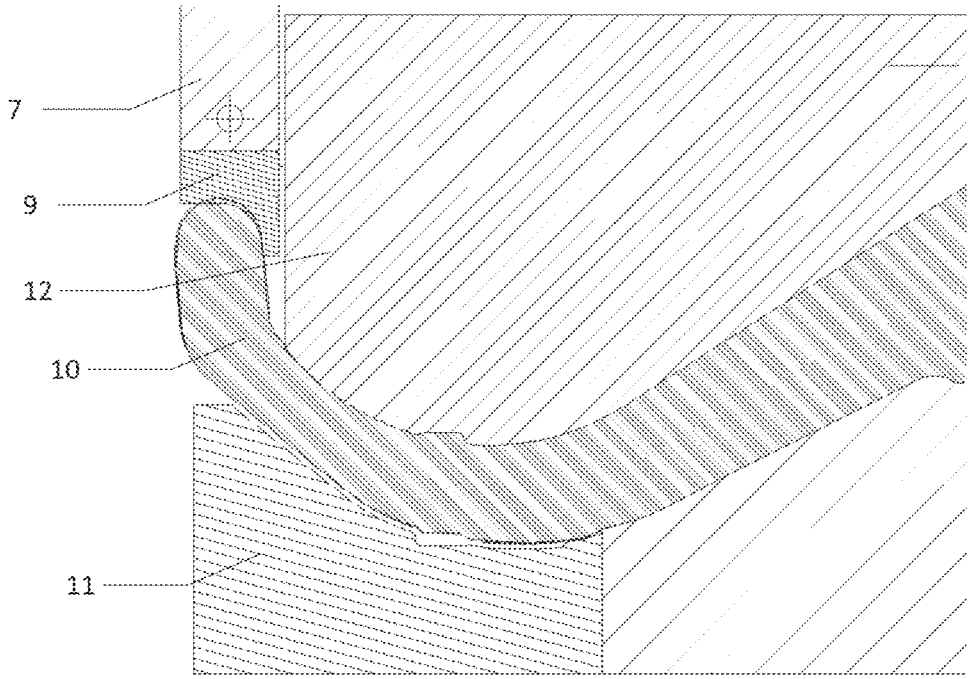
FIG. 3 is a partial structural schematic diagram of the trimming die for the casting of the front steering knuckle in the double-wishbone suspension provided by the present disclosure.

As shown in FIG. 3, in a die closing state, a 1-2 mm gap is reserved between the first supporting block 11 and the casting 10, the pressing block 9 is in slight interference press fit with the casting 10 for generally 1-2 mm, and thus, the casting 10 can achieve a certain correcting effect due to the mutual cooperation of the first supporting block 11 and the pressing block 9 in a die closing process of the trimming die. In order to adapt to different deformations of the casting 10, both the pressing block 9 and the first supporting block 11 are detachable, the correction quantity can be adjusted by changing and adjusting the heights of the pressing block 9 and the first supporting block 11 to adapt to castings with different deformations. According to the present disclosure, a correction function is integrated into a casting fin clearing process by improving the structure of the trimming die for the casting, and the correction quantity can be conveniently adjusted by adjusting the heights of the first supporting block and the pressing block according to the actual deformation of the casting. By using the present disclosure, the casting rejection rate caused by thermal treatment deformation can be effectively reduced, and the economic benefit can be increased.

Second Embodiment

Different from the first embodiment, the second embodiment lies in different arrangement of the pressing block connecting rod 7. Specifically, in the second embodiment, the pressing block connecting rod 7 is detachably connected with the pressing block 9 and the intermediate plate 3. The pressing block is inconvenient to replace, so that the pressing block connecting rod can be arranged to be replaceable, and the pressing block can apply downward pressing forces with different degrees to the goose head of the casting by replacing pressing block connecting rods with different length standards according to different-degree correction demands, so that it is convenient to realize correction with different degrees, and the die is simple in structure and capable of adapting to correction with different degrees.

Based on the above, the present disclosure provides the trimming die for the casting of the front steering knuckle in the double-wishbone suspension. The trimming die includes the upper roof, the intermediate plate, the movable plate, the base, the springs, the connecting columns, the pressing block connecting rod, the cutting edge, the pressing block, the casting, the hold-down blocks, the first supporting block and the second supporting blocks. The gooseneck of the casting is corrected by virtue of the mutual cooperation of the pressing block and the first supporting block, and waste products generated by thermal treatment deformation of the casting are reduced by correcting the casting during trimming, so that the production cost is reduced.

The embodiments of the present disclosure are described in detail above, particular examples are used herein to explain the principle and embodiments of the present disclosure, and the above description of the embodiments is only used for helping understanding the methods and core concept of the present disclosure; and meanwhile, for those having ordinary skill in the art, according to the idea of the present disclosure, there will be changes in the specific implementation mode and present disclosure scope, in conclusion, the contents of the specification shall not be construed as a limitation of the present disclosure.

The invention claimed is:

1. A trimming die for a casting of a front steering knuckle in a double-wishbone suspension, comprising a base, a first supporting block, second supporting blocks and an upper die, wherein the base is located at a bottom of the die, the first supporting block and the second supporting blocks are fixedly arranged on the base, a gooseneck of the casting is supported by the first supporting block, the remaining parts of the casting are supported by the second supporting blocks, the upper surfaces of the first supporting block and the second supporting blocks are respectively adapted to the shapes of the corresponding bottom surfaces of the casting, the second supporting blocks are in complete contact with the casting, and a gap is reserved between the first supporting block and the casting; and the upper die comprises a pressing block, hold-down blocks and a cutting edge, the pressing block is located over a goose head of the casting, the hold-down blocks are located over the remaining parts of the casting, and the pressing block and the hold-down blocks are respectively adapted to the shapes of the corresponding upper surfaces of the casting; the cutting edge is used for clearing fins of the casting, and the pressing block and the cutting edge are capable of moving synchronously; and when the die is closed, the casting is held down by the hold-down blocks pressing against the upper surface, except for the goose head, of the casting, the fins of the casting are cleared by the cutting edge, and the pressing block presses against the goose head of the casting and is in interference fit with the goose head of the casting to realize the correction of the casting.

2. The trimming die for the casting of the front steering knuckle in the double-wishbone suspension according to claim 1, wherein the side face, facing the hold-down blocks, of the pressing block is provided with an extension part adapted to the goose head of the casting in shape, and the extension part extends along the gap between the goose head of the casting and the hold-down blocks; and with the downward pressing of the pressing block, the extension part can be in interference fit with the goose head of the casting.

3. The trimming die for the casting of the front steering knuckle in the double-wishbone suspension according to claim 2, wherein the upper die further comprises an upper roof, an intermediate plate, a movable plate, a plurality of springs, a plurality of connecting columns and a pressing block connecting rod; the intermediate plate is fixedly connected to a bottom surface of the upper roof by a plurality of connecting columns, the movable plate is located between the upper roof and the intermediate plate and is capable of moving up and down relative to the upper roof, the cutting edge is fixedly arranged on a bottom surface of the intermediate plate, and the pressing block is fixedly arranged on the bottom surface of the intermediate plate by the pressing block connecting rod; the plurality of springs are arranged between the movable plate and the upper roof, and the hold-down blocks are located below the intermediate plate and are fixedly arranged on a bottom surface of the movable plate by a plurality of connecting columns; the intermediate plate is provided with through holes for allowing the plurality of connecting columns on the bottom surface of the movable plate to pass through in positions corresponding to the connecting columns on the bottom surface of the movable plate; and the movable plate is provided with through holes for allowing the plurality of connecting columns on the bottom surface of the upper roof to pass through in positions corresponding to the connecting columns on the bottom surface of the upper roof.

4. The trimming die for the casting of the front steering knuckle in the double-wishbone suspension according to claim 3, wherein the length of the pressing block connecting rod is adjustable.

5. The trimming die for the casting of the front steering knuckle in the double-wishbone suspension according to claim 3, wherein the pressing block connecting rod is detachably connected with the pressing block and the intermediate plate.

6. The trimming die for the casting of the front steering knuckle in the double-wishbone suspension according to claim 3, wherein both the pressing block and the first supporting block are detachable, so that the heights of the pressing block and the first supporting block can be conveniently adjusted to adapt to castings with different deformations.

7. The trimming die for the casting of the front steering knuckle in the double-wishbone suspension according to claim 1, wherein the upper die further comprises an upper roof, an intermediate plate, a movable plate, a plurality of springs, a plurality of connecting columns and a pressing block connecting rod; the intermediate plate is fixedly connected to a bottom surface of the upper roof by a plurality of connecting columns, the movable plate is located between the upper roof and the intermediate plate and is capable of moving up and down relative to the upper roof, the cutting edge is fixedly arranged on a bottom surface of the intermediate plate, and the pressing block is fixedly arranged on the bottom surface of the intermediate plate by the pressing block connecting rod; the plurality of springs are arranged between the movable plate and the upper roof, and the hold-down blocks are located below the intermediate plate and are fixedly arranged on a bottom surface of the movable plate by a plurality of connecting columns; the intermediate plate is provided with through holes for allowing the plurality of connecting columns on the bottom surface of the movable plate to pass through in positions corresponding to the connecting columns on the bottom surface of the movable plate; and the movable plate is provided with through holes for allowing the plurality of connecting columns on the bottom surface of the upper roof to pass through in positions corresponding to the connecting columns on the bottom surface of the upper roof.

8. The trimming die for the casting of the front steering knuckle in the double-wishbone suspension according to claim 7, wherein the length of the pressing block connecting rod is adjustable.

9. The trimming die for the casting of the front steering knuckle in the double-wishbone suspension according to claim 7, wherein the pressing block connecting rod is detachably connected with the pressing block and the intermediate plate.

10. The trimming die for the casting of the front steering knuckle in the double-wishbone suspension according to claim 7, wherein both the pressing block and the first supporting block are detachable, so that the heights of the pressing block and the first supporting block can be conveniently adjusted to adapt to castings with different deformations.

11. The trimming die for the casting of the front steering knuckle in the double-wishbone suspension according to claim 1, wherein both the pressing block and the first supporting block are detachable, so that the heights of the pressing block and the first supporting block can be conveniently adjusted to adapt to castings with different deformations.

* * * * *